US008223032B2

(12) United States Patent
Van Gorp et al.

(10) Patent No.: US 8,223,032 B2
(45) Date of Patent: Jul. 17, 2012

(54) MONITORING SYSTEM SUPPORTING PROXIMITY BASED ACTIONS

(75) Inventors: John C. Van Gorp, Sidney (CA); Arthur B. Wynans, Victoria (CA); Clifford Schubert, Victoria (CA)

(73) Assignee: Schneider Electric USA, Inc., Palatine, IL (US)

( * ) Notice: Subject to any disclaimer, the term of this patent is extended or adjusted under 35 U.S.C. 154(b) by 458 days.

(21) Appl. No.: 12/502,687

(22) Filed: Jul. 14, 2009

(65) Prior Publication Data

US 2011/0012743 A1 Jan. 20, 2011

(51) Int. Cl.
*G08B 21/00* (2006.01)

(52) U.S. Cl. ..... 340/686.6; 340/4.36; 340/5.1

(58) Field of Classification Search ..... 340/686.6, 340/825.69, 4.36, 4.31, 5.1, 5.2
See application file for complete search history.

(56) References Cited

U.S. PATENT DOCUMENTS 7,932,809 B2 * 4/2011 Nair et al. ..... 340/5.2
8,014,791 B2 * 9/2011 Guigne et al. ..... 455/456.1
2001/0052858 A1 * 12/2001 Vincent et al. ..... 340/825.69
2004/0148039 A1 7/2004 Farchmin et al.
2007/0205861 A1 9/2007 Nair et al.
2009/0121890 A1 * 5/2009 Brown et al. ..... 340/686.6

OTHER PUBLICATIONS

Written Opinion International Search Authority, International Application No. PCT/US2010/040889, 5 pages, dated Nov. 18, 2010.
International Search Report , International Application No. PCT/US2010/040889, 3 pages, dated Nov. 18, 2010.

* cited by examiner

*Primary Examiner* — Toan N Pham
(74) *Attorney, Agent, or Firm* — Nixon Peabody LLP

(57) ABSTRACT

A monitoring system includes a discoverable wireless device, a proximity monitor, and a monitoring server. The proximity monitor is configured to automatically discover the discoverable wireless device in response to the discoverable wireless device being within a wireless range of the proximity monitor. The monitoring server is communicatively connected to the proximity monitor via a communications network. The monitoring server is configured to i) receive proximity information associated with the discoverable wireless device from the proximity monitor, and ii) transmit an instruction signal based on the received proximity information to an electrical component located remotely from the proximity monitor. The instruction signal causes the electrical component to modify an operating parameter of the electrical component.

19 Claims, 3 Drawing Sheets

MONITORING SYSTEM SUPPORTING PROXIMITY BASED ACTIONS

FIELD OF THE INVENTION

The present invention relates generally to electrical equipment and, more particularly, to monitoring systems that support proximity based actions.

BACKGROUND OF THE INVENTION

Existing power monitoring systems often include local user interfaces such as a power meter for a user to view information about equipment being monitored and/or to modify parameters and settings of the equipment. Typically, the local user interfaces require the user to be authorized to modify parameters and settings of the equipment or to initiate some action or control some features of the equipment. Authorization of the user is usually obtained by entering a password or pin on a keypad connected to the local user interface. Entry of the password typically requires physical contact of the user with the local user interface and very close proximity to the equipment being monitored, which represents increased safety and security risks.

Thus, a need exists for an improved method and system. The present disclosure is directed to satisfying one or more of these needs and solving other problems.

SUMMARY OF THE INVENTION

According to some embodiments, a monitoring system includes a discoverable wireless device, a proximity monitor, and a monitoring server. The proximity monitor is configured to automatically discover the discoverable wireless device in response to the discoverable wireless device being within a wireless range of the proximity monitor. The monitoring server is communicatively connected to the proximity monitor via a communications network. The monitoring server is configured to i) receive proximity information associated with the discoverable wireless device from the proximity monitor, and ii) transmit an instruction signal based on the received proximity information to an electrical component located remotely from the proximity monitor. The instruction signal causes the electrical component to modify an operating parameter of the electrical component.

According to some embodiments, a discoverable wireless device monitoring system for controlling a plurality of electrical components includes a discoverable wireless device and a plurality of proximity monitors. Each of the plurality of proximity monitors is configured to automatically discover the discoverable wireless device in response to the discoverable wireless device being within a respective wireless range of each one of the plurality of proximity monitors. At least one of the plurality of proximity monitors is configured to determine a distance of the discoverable wireless device from a first one of the plurality of electrical components in response to the discoverable wireless device being within at least two of the respective wireless ranges of the plurality of proximity monitors. The at least one proximity monitor is configured to transmit an instruction signal based on the determined distance to the first electrical component. The instruction signal causes the first electrical component to modify an operating parameter of the first electrical component.

According to some embodiments, a method of controlling a plurality of electrical components includes monitoring for a presence of discoverable wireless devices, determining that a first one of the discoverable wireless devices is positioned within a wireless range of two or more proximity monitors, and estimating a location of the first discoverable wireless device with respect to a first one of the plurality of electrical components. The method further includes determining that the estimated location of the first discoverable wireless device is less than a predetermined distance from the first electrical component and in response to the determining that the estimated location is less than the predetermined distance, transmitting an instruction signal from at least one of the two or more proximity monitors to the first electrical component to cause the first electrical component to modify an operating parameter of the first electrical component, thereby switching the first electrical component from an ON state to a SAFETY state.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

DETAILED DESCRIPTION OF THE ILLUSTRATED EMBODIMENTS

Although the invention will be described in connection with certain aspects and/or embodiments, it will be understood that the invention is not limited to those particular aspects and/or embodiments. On the contrary, the invention is intended to cover all alternatives, modifications, and equivalent arrangements as may be included within the spirit and scope of the invention as defined by the appended claims.

Figure 1:
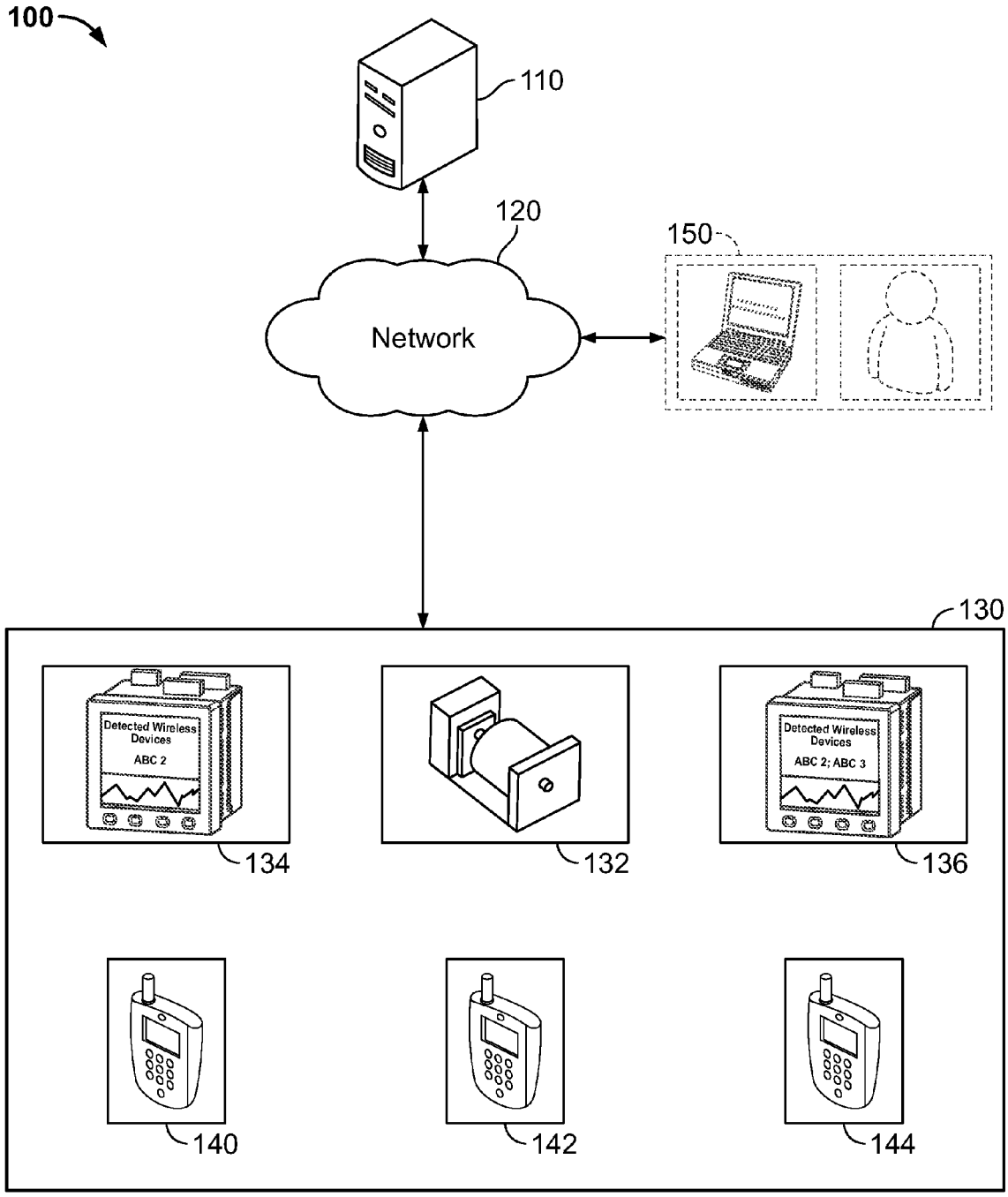
FIG. 1 is a flow diagram of a centralized monitoring system according to some embodiments of the present disclosure.

Referring to FIG. 1, a monitoring system 100 is shown according to some embodiments of the present disclosure. The monitoring system 100 includes a monitoring server 110, a network 120, and an equipment site 130. The monitoring system 100 can be communicatively connected to one or more system terminals 150 located within or remote from the equipment site 130. The monitoring system 100 can be a utility monitoring system. The utility system being monitored by the monitoring system 100 can be any of the five utilities designated by the acronym WAGES, or water, air, gas, electricity, or steam. The monitoring system 100 may also monitor emissions related to the WAGES utilities, such as, for example, wastewater and greenhouse gas emissions. For simplicity, several of the examples given in the follow disclosure generally describe the monitoring system 100 as a power monitoring system; however, it is understood that the monitoring system 100 can be applied to any of the WAGES utilities.

The equipment site 130 includes electrical equipment 132, a first proximity monitor 134, a second proximity monitor 136, a first wireless device 140, a second wireless device 142, and a third wireless device 144. The monitoring server 110 can be directly or indirectly communicatively connected to the electrical equipment 132, the first and the second proximity monitors 134, 136, or both via the network 120. The network 120 can be an internal or local network (e.g., LAN) or an external network (e.g., WAN, Internet, etc.). The monitoring server 110 can be located within the equipment site 130 or remote from the equipment site 130.

Figure 2:
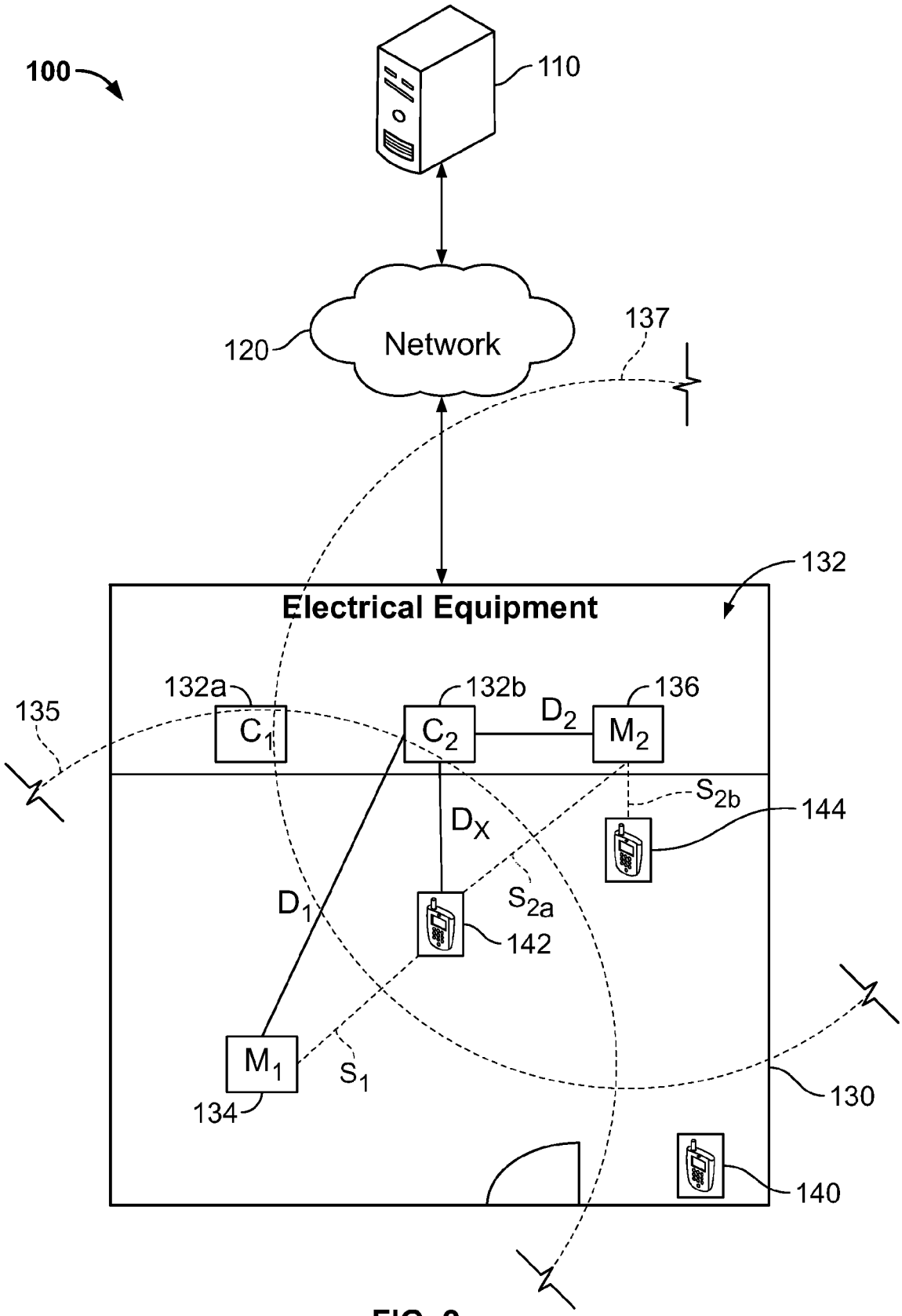
FIG. 2 is a flow diagram of the centralized monitoring system of FIG. 1 according to some embodiments of the present disclosure.

The wireless devices 140, 142, 144 are discoverable wireless devices. That is, a presence of the first, the second, and the third wireless devices 140, 142, 144 can be detected using one or more wireless protocols that support wireless detection. Examples of such wireless protocols include Bluetooth, IEEE 802.15.4, and mesh networking methods running on top of other wireless protocols such as IEEE 802.11. The wireless devices 140, 142, 144, can be mobile phones, "key fob" transmitters, or other wireless devices capable of being wirelessly discovered using wireless protocols supporting wireless detection. While the equipment site 130 is shown as having a particular arrangement and number of components in FIG. 1, various other arrangements and numbers of electrical equipment, proximity monitors, and wireless devices are contemplated, such as the arrangement and number of components shown in FIG. 2. Additionally, while the electrical components 132*a,b* are shown in FIG. 2 with a particular orientation and position relative to the first and the second proximity monitors 134, 136 within the equipment site 130, it is contemplated that the electrical components 132*a,b* of the electrical equipment 132 can be located (1) adjacent to one or more of the first and the second proximity monitors 134, 136, (2) remote from the first and the second proximity monitors 134, 136, or (3) within or integral to one of the first and the second proximity monitors 134, 136. For example, the first and the second proximity monitors 134, 136 can be integral with a power monitor or power meter configured to monitor one or more electrical characteristics of an electrical utility system.

Generally referring to FIGS. 1 and 2, the electrical equipment 132 includes one or more electrical components 132*a,b*. The electrical equipment 132 can also include one or more proximity monitors, such as, for example, the second proximity monitor 136, as shown in FIG. 2. The electrical components 132*a,b* can include high voltage power distribution equipment (e.g., equal to or greater than 12,000 Volts), medium voltage power distribution equipment (e.g., between 480 Volts and 12,000 Volts), low voltage power distribution equipment (e.g., equal to or less than 480 Volts), electrical panels, circuit breakers, switches, busway sections, power meters, fans, pumps, trip units, uninterruptable power supplies, generators, power transformers, electric motors, capacitor banks, relays, or any combination thereof. The equipment site 130 can be an outdoor site such as a power plant or an indoor site such as a power room or an electrical room in a building, as shown in FIG. 2.

The first and the second proximity monitors 134, 136 monitor for a presence of discoverable wireless devices using a wireless communication protocol that supports wireless detection or discovery of nearby nodes such as the wireless devices 140, 142, 144. The first and the second proximity monitors 134, 136 automatically discover the presence of the wireless devices 140, 142, 144 in response to (1) the wireless devices 140, 142, 144 being physically within a respective wireless range 135, 137 of the first proximity monitor 134 and/or the second proximity monitor 136 and (2) the wireless devices 140, 142, 144 being configured to be discoverable. That is, the first and the second proximity monitors 134, 136 automatically determine the presence of wireless devices within their respective wireless range 135, 137 that are configured to be discoverable. For example, a wireless standard such as Bluetooth allows devices to optionally be discoverable. In such an example, the device must first be configured to be discoverable before a proximity monitor would discover the device, even if the device was within a wireless range of the proximity monitor.

The wireless ranges 135, 137 are illustrated as dashed circles centered about the first and the second proximity monitors 134, 136, respectively. The wireless ranges 135, 137 can be configured to various ranges such that the first and the second proximity monitors 134, 136 detect wireless devices therein at various distances, such as, for example, ten, twenty, thirty, forty feet, etc. For example, as shown in FIG. 2, the first wireless device 140 is outside of the wireless ranges 135, 137 of the first and the second proximity monitors 134, 136, and is thus not detected by the monitoring system 100. However, the monitoring system 100 detects the second and the third wireless devices 142, 144 because the second wireless device 142 is within the first and the second wireless ranges 135, 137 and the third wireless device 144 is within the second wireless range 137.

In response to the first proximity monitor 134 and/or the second proximity monitor 136 discovering a wireless device, a unique identifier or wireless device identifier of the discovered wireless device is received and/or stored in the proximity monitor that discovered the wireless device. For example, the third wireless device 144 is associated with a unique identifier of ABC3. The unique identifier ABC3 can be embedded within a memory of the third wireless device 144 such that when the third wireless device 144 is within the second wireless range 137 of the second proximity monitor 136, the second proximity monitor 136 (1) discovers the presence of the third wireless device 144, (2) receives and/or discovers the unique identifier ABC3 associated with the third wireless device 144, and (3) stores the received and/or discovered unique identifier ABC3 in a memory of the second proximity monitor 136.

Similarly, the first wireless device 140 is associated with a unique identifier of ABC1 and the second wireless device 142 is associated with a unique identifier of ABC2. As the first wireless device 140 is outside of all available wireless ranges, the first wireless device is not discovered and its unique identifier remains unknown to the monitoring system 100. However, because the second wireless device 142 is within the first and the second wireless ranges 135, 137, both the first and the second proximity monitors 134, 136 (1) discover the presence of the second wireless device 142, (2) receive and/or discover the unique identifier ABC2 associated with the second wireless device 142, and (3) store the received and/or discovered unique identifier ABC2 in respective memories of the first and the second proximity monitors 134, 136.

The proximity monitors 134, 136 can time stamp a unique identifier upon receipt to mark an entry time of an associated wireless device into a wireless range. Similarly, the proximity monitors 134, 136 can periodically track the presence of a wireless device within their respective wireless ranges at a predetermined interval and time stamp the associated unique identifier in response to the wireless device being absent from the wireless range, thereby marking an exit time of the wireless device from the wireless range. For example, for a predetermined tracking interval of five seconds, the third wireless device 144 enters the equipment site at 10:00:01 AM. The second proximity monitor 136 first detects the presence of the third wireless device 144 at 10:00:05 AM. The second proximity monitor 136 is configured to time stamp the unique identifier ABC3 of the third wireless device 144 with an entry time of 10:00:05 AM. In the same example, the third wireless device 144 leaves the equipment site 130 at 10:05:32 AM. The second proximity monitor 136 first detects the absence of the third wireless device 144 at 10:05:35. The second proximity monitor 136 is configured to time stamp the unique identifier ABC3 of the third wireless device 144 with an exit time of 10:30:35 AM. Such time stamp data can be analyzed by the monitoring server 110 and/or a system user of the system terminal 150 for safety reasons, security purposes, and/or other contemplated uses. It is contemplated that the system user can use the system terminal 150 to view information associated with discovered wireless devices (e.g., unique identifiers, time stamp data, etc.) and actions taken in response thereto by the monitoring server 110 (e.g., instructions to switch to OFF state, SAFETY state, etc.).

The first and the second proximity monitors 134, 136 measure a wireless signal strength, S, of present and discovered wireless devices over time. As shown in FIG. 2, the first proximity monitor 134 detects and measures the wireless signal strength $S_1$ of the second wireless device 142. Similarly, the second proximity monitor 136 detects and measures the wireless signal strengths $S_{2a}$ and $S_{2b}$ of the second and the third wireless devices 142, 144, respectively. As the wireless devices 140, 142, 144 move within the equipment site 130, the measured wireless signal strengths S change accordingly. For example, as the second wireless device 142 moves closer to the second electrical component 132*b*, the wireless signal strength $S_1$ decreases and the wireless signal strength $S_{2a}$ increases because the second wireless device 142 is moving away from the first proximity monitor 134 and closer to the second proximity monitor 136. The change in wireless signal strength over time can be analyzed by the monitoring server 110 to determine a direction of movement of the second wireless device 142 within the equipment site 130 and/or to estimate an updated location of the second wireless device 142 within the equipment site 130.

The first and the second proximity monitors 134, 136 transmit proximity information via the network 120 to the monitoring server 110. The first and the second proximity monitors 134, 136 can be configured to transmit the proximity information to the monitoring server 110 at predetermined intervals (e.g., every second, every minute, every five minutes), upon discovering one or more wireless devices, upon determining that a wireless device is absent from one or all of the wireless ranges, or a combination thereof. The proximity information is associated with one or more discoverable wireless devices that are currently or were previously within one or more of the wireless ranges 135, 137 of the first and the second proximity monitors 134, 136. The proximity information can include unique identifiers, wireless signal strengths, or a combination thereof. The wireless signal strengths included in the proximity information can be a single wireless signal strength measurement for a particular discoverable wireless device, or the wireless signal strengths can be a series or table of wireless signal strength measurements for a particular discoverable wireless device measured at a predetermined interval (e.g., one wireless signal strength measurement every second, every five seconds, every minute, every ten minutes, etc.).

For example, as shown in FIG. 2, the third wireless device 144 is only within the second wireless range 137 of the second proximity monitor 136 and the second wireless device 142 is within the first and the second wireless ranges 135, 137 of the first and the second proximity monitors 134, 136. In this example, first proximity information is transmitted from the first proximity monitor 134 to the monitoring server 110 and second proximity information is transmitted from the second proximity monitor 136 to the monitoring server 110. The first proximity information includes the wireless signal strength $S_1$ and the unique identifier ABC2 of the second wireless device 142. Similarly, the second proximity information includes the wireless signal strengths $S_{2a}$, $S_{2b}$ and the unique identifiers ABC2 and ABC3 of the second and the third wireless devices 142, 144, respectively.

The monitoring server 110 can analyze and/or process the first and the second proximity information and/or additional or updated proximity information transmitted periodically to calculate and/or estimate positional locations of wireless devices within the equipment site 130, lineal distances of one or more wireless devices present within the equipment site 130 with respect to one or more of the electrical components 132*a,b*, and/or directions of movement of the wireless devices discovered within the equipment site 130. For example, the monitoring server 110 can estimate a lineal distance $D_x$ of the second wireless device 142 from the second electrical component 132*b*. The monitoring server 110 can estimate $D_x$ based on an analysis of the wireless signal strengths $S_1$, $S_{2a}$ and based on one or more known distances, such as, for example, $D_1$ and $D_2$, and/or known positional locations of the proximity monitors 134, 136 and/or the electrical components 132*a,b* within the equipment site 130. It is contemplated that $D_x$ can be estimated according to other known conventional techniques with or without knowing distances $D_1$ and $D_2$ and/or the positional locations of the first and the second proximity monitors 134, 136 and/or the electrical components 132*a,b* within the equipment site 130. Additionally or alternatively, the proximity monitors 134, 136 can use one or more directional antennas—each with a separate wireless signal strength measurement—to increase the accuracy of estimated positional locations of one or more of the wireless devices 140, 142, 144 within the equipment site 130 and/or the estimated lineal distance $D_x$ measurement.

The monitoring server 110 can use the received proximity information directly and/or information calculated therefrom to take one or more actions. That is, the monitoring server 110 can take an action based solely on discovery of one or more wireless devices within the equipment site 130 and/or based on one or more estimated positional locations or estimated lineal distances, such as, $D_x$, which represents a wireless device's proximity to one or more electrical components within the equipment site 130. The action is implemented by transmitting an instruction signal via the network 120 to one or more of the electrical components 132*a,b* and/or to the electrical equipment 132 generally. The instruction signal causes the electrical component receiving the instruction signal to modify one or more of its operating parameters.

Depending on the action and/or the instruction signal, the operating parameter can be one of a variety of operating parameters of one or more of the electrical components 132*a,b* included in the electrical equipment 132. The operating parameter of the electrical component can be an ON/OFF state of the electrical component such that the instruction signal causes the electrical component to shut off. For example, the second electrical component 132*b* can be a large fan. In this example, the instruction signal transmitted to the fan 132*b* causes the fan 132*b* to shut off. The monitoring server 110 might transmit such an instruction signal in response to estimating that $D_x$ is less than a predetermined safety distance threshold. For example, if $D_x$ is five feet and the predetermined safety distance threshold is ten feet, the second wireless device 142 and its human user are about five feet away from the potentially dangerous fan 132*b*, which can automatically trigger the fan 132*b* to shut off via the instruction signal. Alternatively, the monitoring server 110 might transmit such an instruction signal to the fan 132*b* in response to determining that the second wireless device 142 and/or the third wireless device 144 is present within the equipment site 130. Alternatively or additionally, the monitoring system 100 can cause an audible and/or a visual alarm to trigger within the equipment site 130 to alert the human user to the potential danger of the fan 132*b*.

The operating parameter of the electrical component can be an ON/STANDBY state of the electrical component such that the instruction signal causes the electrical component to switch from an ON state to a STANDBY state and/or from a STANDBY state to an ON state. For example, the electrical equipment 132 includes three pumps (not shown) operating within the monitoring system 100. The monitoring system 100 requires only two of the three pumps to be ON at a given time, thus, the third pump is in the STANDBY state, that is, not running. In this example, a wireless device is automatically detected near one of the pumps that is in the ON state. In response to the discovery of the wireless device, the monitoring server 110 transmits a first instruction signal to the pump closest to the detected wireless device to cause that pump to switch from the ON state to the STANDBY state. Similarly, the monitoring server 110 transmits a second instruction signal to the pump in the STANDBY state to cause that pump to switch from the STANDBY state to the ON state, thus, keeping the system running with two pumps. The switching of pumps between the ON state and the STANDBY state can increase the equipment site 130 safety for a user of the wireless device in close proximity to any one of the three pumps.

The operating parameter of the electrical component can be a temperature threshold of the first electrical component 132*a*. For example, the first electrical component 132*a* is an electrical panel and/or busway section and the second electrical component 132*b* is a fan that is preprogrammed to turn on and cool the electrical panel and/or busway section 132*a* in response to the electrical panel and/or busway section 132*a* reaching or exceeding a preprogrammed temperature threshold (e.g., 150 degrees Celsius). In this example, the instruction signal modifies and/or changes the preprogrammed temperature threshold such that the fan 132*b* turns on in response to the electrical panel and/or busway section 132*a* reaching or exceeding a temperature higher than the preprogrammed temperature (e.g., 160, 170, 200 degrees Celsius or higher). Such an increased temperature threshold can increase the safety of a user of the second wireless device 142 as the fan 132*b* can pose a threat and/or high risk of injury to a human user of the second wireless device 142 when present in the equipment site 130 and/or in close proximity thereto.

The operating parameter of the electrical component can be a current trip threshold of the first electrical component 132*a*. For example, the first electrical component 132*a* is a circuit breaker that is preprogrammed to trip a circuit in response to a current flowing therethrough reaching or exceeding a preprogrammed current trip threshold. In this example, the instruction signal modifies and/or changes the preprogrammed current trip threshold such that the circuit breaker 132*a* trips in response to a lower current flow than the preprogrammed current trip threshold. The monitoring server 110 might transmit such an instruction signal in response to determining that the second wireless device 142 and/or the third wireless device 144 is present within the equipment site 130. While such a decreased current trip threshold can result in more nuisance trips, the decreased trip threshold can also increase the safety of a user of the second and/or the third wireless devices 142, 144 when present in the equipment site 130 and/or in close proximity thereto.

The operating parameter of the electrical component can be modified and/or changed via the instruction signal such that the first electrical component 132*a* is switched from an ON state to a SAFETY state. In the SAFETY state the first electronic component 132*a* can be OFF. Alternatively or additionally, in the SAFETY state a current trip threshold associated with the first electrical component 132*a* can be lowered. Alternatively or additionally, in the SAFETY state a current flow to the first electronic component 132*a* can be reduced. The operating parameter of the electrical component can be modified such that the first electrical component 132*a* is switched back from the SAFETY state to the ON state via a second instruction signal. The monitoring server 110 can be configured to transmit the second instruction signal at a predetermined time after no wireless devices are detected within the equipment site 130. Alternatively, the monitoring server 110 can be configured to transmit the second instruction signal in response to the monitoring system 100 determining that the wireless device moved to a different location away from or at least a predetermined distance from the first electrical component 132*a*.

Alternatively or in addition to the instruction signal causing the electrical component receiving the instruction signal to modify one or more of its operating parameters, the instruction signal can cause a user of a discovered wireless device to be granted access. Access is determined based on an access level or clearance level associated with each unique identifier. The clearance levels associated with each known unique identifier that can potentially be discovered within the equipment site 130 can be stored within the monitoring server 110 and/or a memory or database of the monitoring system 100. The access granted can be electronic access. For example, the instruction signal can cause the second proximity monitor 136 to grant a user of the third wireless device 144 access to one or more restricted features of the second proximity monitor 136 itself and/or any other electrical component within the electrical equipment 132. The monitoring server 110 determines an amount of access available to the user of the third wireless device 144 based on clearance level associated with the unique identifier ABC3 of the third wireless device 144. Depending on the clearance level associated with the unique identifier ABC3, the user of the third wireless device 144 can have complete access to all features including safety mode setup features, or access to only a basic set of features of the electrical equipment 132.

The instruction signal can cause a user of a discovered wireless device to be granted physical access to the equipment site 130 and/or physical access to one or more separate rooms within the equipment site 130. For example, the electrical equipment 132 can be separated into one or more high voltage rooms and one or more distinct and separate medium and/or low voltage rooms. In this example, depending on the clearance level associated with a discovered wireless device, the user of the discovered wireless device can be granted physical access into the equipment site 130 and based on that clearance level the user can also be granted physical access into the high voltage room (not shown).

Physical access into the equipment site 130 and/or electronic access into one or more features of the electrical equipment 132 and/or the proximity monitors 134, 136 can be restricted based on one or more approved user patterns. For example, if a user of a wireless device is only supposed to be within the equipment site 130 during the daytime, the monitoring server 110 can be configured to transmit instruction signals to the proximity monitors 134, 136 and/or the electrical equipment 132 to grant the user access only during the daytime (e.g., 8 AM to 5 PM). That is, if the user's wireless device was discovered by one of the proximity monitors 134, 136 after 5 PM, the monitoring server 110 would not send an instruction signal to grant that user access. Additionally or alternatively, the monitoring server 110 can log the attempted unauthorized access to the equipment site 130 and/or sound an alarm at the equipment site 130 and/or at one or more other predetermined locations, such as, a security building or police station.

For another example, access can be granted only in response to more than one wireless device being discovered. That is, access to certain features can be denied to a user of a wireless device that is alone in the equipment site 130; however, access can be granted to that same user in response to a second authorized wireless device being discovered in the equipment site 130 at the same time. Similarly, access can be denied in response to more than one wireless device being discovered. For another example, access can be granted to one or more authorized wireless devices in response to no unauthorized wireless devices being discovered in proximity to the one or more authorized wireless devices.

Figure 3:
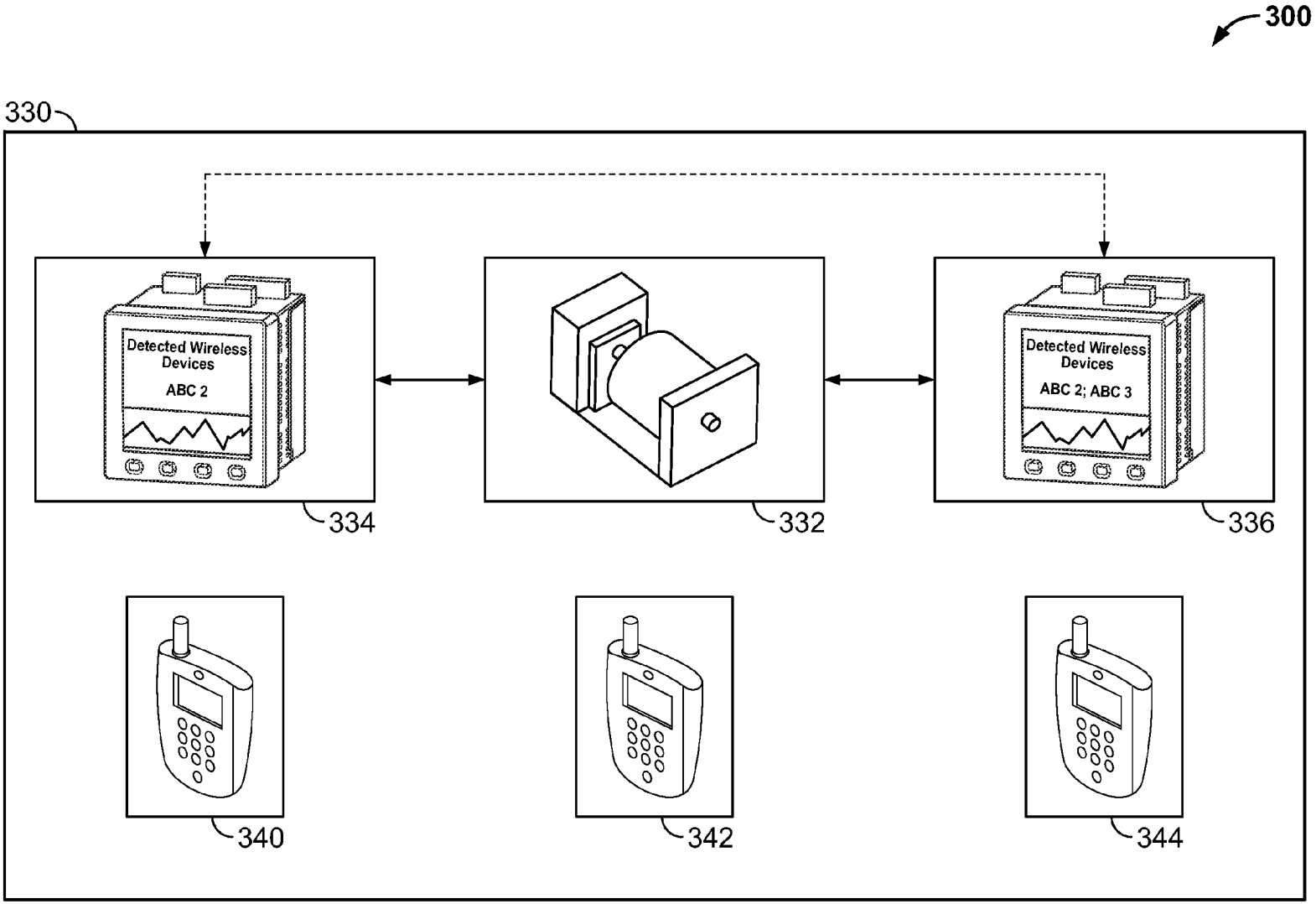
FIG. 3 is a flow diagram of a decentralized monitoring system according to some embodiments of the present disclosure.

Now referring to FIG. 3, a decentralized monitoring system 300 is shown according to some embodiments of the present disclosure. The monitoring system 300 is similar to the monitoring system 100 in that the equipment site 330 of the monitoring system 300 includes electrical equipment 332, a first proximity monitor 334, a second proximity monitor 336, and wireless devices 340, 342, 344, which are the same as, or similar to, the electrical equipment 132, the first proximity monitor 134, the second proximity monitor 136, and the wireless devices 140, 142, 144 of the monitoring system 100.

The monitoring system 300 differs from the monitoring system 100 in that a monitoring server is not used. The first and the second proximity monitors 334, 336 are communicatively connected thereto and with the electrical equipment 332 such that proximity information can be transferred between the proximity monitors 334, 336. Either of the proximity monitors 334, 336 can directly transmit an instruction signal to the electrical equipment 332 and/or one or more electrical components of the electrical equipment 332 in the same or similar manner as described above in reference to the monitoring server 110 transmitting instructions signals to the electrical equipment 132 and/or electrical components 132*a, b*.

It is contemplated that the proximity monitors 134, 136, 334, 336 can communicate information to users of the wireless devices 140, 142, 144, 340, 342, 344 via local user interfaces, such as, for example, displays in the equipment room 130, 330 in response to discovering the wireless device and/or estimating a position of the wireless device within the equipment room 130, 330. The proximity monitors 134, 136, 334, 336 can also communicate information by pushing the information to the wireless device directly. The information can be sent to the wireless devices 140, 142, 144, 340, 342, 344 using SMS messaging, e-mail, pages, voice calls, etc. Depending on an urgency of the information, the information can be communicated in different manners. For example, for urgent information, the information can be sent as an automated voice call and for regular priority information, the information can be sent as a SMS text message. The information can be custom tailored to the user of the wireless device receiving the information. For example, if the user is a power quality analyst, the information can include harmonics and THD. If the user is a plant manager, the information can include amps, volts, and energy readings.

While particular aspects, embodiments, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A power monitoring system, comprising:

a discoverable wireless device;

a proximity monitor configured to automatically discover the discoverable wireless device in response to the discoverable wireless device being within a wireless range of the proximity monitor;

a monitoring server communicatively connected to the proximity monitor via a communications network, the monitoring server being configured to:

i) receive from the proximity monitor proximity information associated with the discoverable wireless device, and ii) transmit an instruction signal based on the received proximity information to at least one of a plurality of electrical components located remotely from the proximity monitor, the plurality of electrical components including power distribution equipment operating at or above 480 volts, the instruction signal causing the at least one of the electrical components to modify an operating parameter of the at least one of the electrical components, wherein the proximity monitor is further configured to monitor one or more electrical characteristics of the power distribution equipment, the proximity monitor being integral with one of the plurality of electrical components.

2. The power monitoring system of claim 1, wherein the operating parameter is an ON/OFF state of the at least one of the electrical components.

3. The power monitoring system of claim 1, wherein one of the plurality of electrical components includes a fan and the operating parameter is a temperature threshold of a second one of the plurality of electrical components.

4. The power monitoring system of claim 1, wherein the at least one of the electrical components includes a circuit breaker and the operating parameter is a trip threshold of the circuit breaker.

5. The power monitoring system of claim 1, wherein the discoverable wireless device is associated with a unique identifier that is automatically discovered by the proximity monitor in response to the discoverable wireless device being within the wireless range of the proximity monitor, the proximity information including the unique identifier.

6. The power monitoring system of claim 5, wherein the unique identifier of the discoverable wireless device is associated with a clearance level.

7. The power monitoring system of claim 6, wherein the instruction signal causes a user of the discoverable wireless device to be granted access to one or more restricted features of the at least one of the electrical components, the proximity monitor, or both, based on the clearance level associated with the discoverable wireless device.

8. The power monitoring system of claim 1, wherein the instruction signal causes a user of the discoverable wireless device to be granted physical access to the power distribution equipment.

9. The monitoring system of claim 1, wherein the instruction signal causes a user of the discoverable wireless device to be granted access to one or more restricted features of at least one of the electrical components, the proximity monitor, or both, based on a clearance level associated with the discoverable wireless device.

10. A discoverable wireless device monitoring system for controlling a plurality of electrical components, the system comprising:

a discoverable wireless device;

a plurality of proximity monitors, each proximity monitor being configured to automatically discover the discoverable wireless device in response to the discoverable wireless device being within a respective wireless range of each one of the plurality of proximity monitors, at least one of the plurality of proximity monitors being configured to determine a distance of the discoverable wireless device from a first one of the plurality of electrical components in response to the discoverable wireless device being within at least two of the respective wireless ranges of the plurality of proximity monitors, the first electrical component being remote from the plurality of proximity monitors, the at least one proximity monitor being configured to transmit an instruction signal based on the determined distance to the first electrical component, the instruction signal causing the first electrical component to modify an operating parameter of the first electrical component, each proximity monitor being configured to measure a wireless signal strength produced by the discoverable wireless device at a predetermined time interval to determine the distance and a direction of movement of the discoverable wireless device relative to the first electrical component.

11. The monitoring system of claim 10, wherein the instruction signal further causes the first electrical component to turn off in response to the distance of the discoverable wireless device from the first electrical component being less than a predetermined amount.

12. The monitoring system of claim 10, wherein the instruction signal further causes the first electrical component to grant a user of the discoverable wireless device access to restricted features of the first electrical component in response to the distance of the discoverable wireless device from the first electrical component being less than a predetermined amount.

13. The monitoring system of claim 10, wherein the plurality of electrical components comprises power distribution equipment, one or more fans, one or more pumps, one or more circuit breakers, one or more electrical panels, one or more power meters, or any combination thereof, two or more of the plurality of proximity monitors being configured to collectively determine the distance of the discoverable wireless device from the first electrical component.

14. A method of controlling a plurality of electrical components, comprising:

monitoring for a presence of discoverable wireless devices;

determining that a first one of the discoverable wireless devices is positioned within a wireless range of two or more proximity monitors;

measuring a wireless signal strength produced by the first discoverable wireless device at a predetermined time interval to determine a distance and a direction of movement of the first discoverable wireless device with respect to a first one of the plurality of electrical components;

estimating a location of the first discoverable wireless device with respect to the first one of the plurality of electrical components, the first electrical component being remote from the two or more proximity monitors;

determining that the estimated location of the first discoverable wireless device is less than a predetermined distance from the first electrical component; and in response to the determining that the estimated location is less than the predetermined distance, transmitting an instruction signal from at least one of the two or more proximity monitors to the first electrical component to cause the first electrical component to modify an operating parameter of the first electrical component, thereby switching the first electrical component from an ON state to a SAFETY state.

15. The method of claim 14, wherein in the SAFETY state the first electrical component is off.

16. The method of claim 14, wherein in the SAFETY state a trip threshold associated with the first electrical component is lowered, and wherein the first electrical component is an electronic circuit breaker.

17. The method of claim 14, wherein in the SAFETY state a current flow to the first electrical component is reduced.

18. The method of claim 14, further comprising:

tracking the first discoverable wireless device via the two or more proximity monitors;

estimating an updated location of the first discoverable wireless device with respect to the first electrical component;

determining that the updated location of the first discoverable wireless device is greater than the predetermined distance from the first electrical component; and in response to the determining that the updated location is greater than the predetermined distance, transmitting a second instruction signal from at least one of the two or more proximity monitors to the first electrical component to cause the first electrical component to modify the operating parameter of the first electrical component, thereby switching the first electrical component from the SAFETY state to the ON state a predetermined period of time after receiving the second instruction signal.

19. The method of claim 14, further comprising causing a user of the first discoverable wireless device to be granted access to one or more restricted features of the first one of the plurality of electrical components based on a clearance level associated with the first discoverable wireless device.

* * * * *